US012024385B2

(12) United States Patent
Miyake et al.

(10) Patent No.: US 12,024,385 B2
(45) Date of Patent: Jul. 2, 2024

(54) MEDIUM TRANSPORT DEVICE AND RECORDING APPARATUS

(71) Applicant: SEIKO EPSON CORPORATION, Tokyo (JP)

(72) Inventors: Toshio Miyake, Shiojiri (JP); Haruki Miyasaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 17/166,295

(22) Filed: Feb. 3, 2021

(65) Prior Publication Data

US 2021/0237991 A1 Aug. 5, 2021

(30) Foreign Application Priority Data

Feb. 5, 2020 (JP) ..... 2020-017997

(51) Int. Cl.
*B65H 3/06* (2006.01)
*B65H 3/34* (2006.01)
*B65H 5/06* (2006.01)

(52) U.S. Cl.
CPC ..... *B65H 3/0653* (2013.01); *B65H 3/0669* (2013.01); *B65H 3/34* (2013.01); *B65H 5/06* (2013.01)

(58) Field of Classification Search
CPC ..... B65H 3/34; B65H 3/56; B65H 3/0669; B65H 2403/41
See application file for complete search history.

(56) References Cited

U.S. PATENT DOCUMENTS 7,210,677 B2 * 5/2007 Fukumura ..... B65H 3/0684 271/10.09
8,231,122 B2 * 7/2012 Tu ..... B65H 3/565 271/121
8,528,895 B2 * 9/2013 Hanamoto ..... B65H 3/0684 271/117
2006/0236331 A1 10/2006 Chang et al.
2012/0133095 A1 5/2012 Tu
2013/0241139 A1 9/2013 Hayakawa

FOREIGN PATENT DOCUMENTS

CN 103569702 2/2014
JP 2000-335769 A 12/2000
JP 2003267577 A * 9/2003
JP 2006-225151 A 8/2006
JP 5924052 B 4/2016

* cited by examiner

*Primary Examiner* — Howard J Sanders
(74) *Attorney, Agent, or Firm* — WORKMAN NYDEGGER

(57) ABSTRACT

A medium feeder includes: a path blocking member configured to rotate to switch between a blocking state that blocks a feed path for a medium fed out from a tray at a position of the guide member, and an open state that opens the feed path; and a switching unit that performs switching of the path blocking member, wherein the switching unit includes a rack configured to be displaced in a feeding direction in which a medium is fed from the tray to thereby perform switching of the path blocking member, and a pinion gear that drives the rack.

11 Claims, 13 Drawing Sheets

MEDIUM TRANSPORT DEVICE AND RECORDING APPARATUS

The present application is based on, and claims priority from JP Application Serial Number 2020-017997, filed Feb. 5, 2020, the disclosure of which is hereby incorporated by reference herein in its entirety.

BACKGROUND

1. Technical Field

The present disclosure relates to a medium feeder that feeds a medium, and a recording apparatus including the same.

2. Related Art

In the following description, a printer will be described as an example of the recording apparatus. The printer includes a feeder that feeds out sheets of recording paper as an example of the medium from a tray that in which sheets of recording paper are loaded. In particular, the feeder to which a tray is attached in a horizontal posture includes a guide slope at a position facing a leading edge of paper sheet to guide the leading edge of paper sheet downstream, and, when the tray is attached to the feeder, the leading edge of paper sheet faces the guide slope. The guide slope may also perform a separation function of separating the paper sheets.

As an example of such a printer, JP-A-2000-335769 discloses a configuration having a shutter that abuts a leading edge of a paper sheet stacked on a tray to prevent the paper sheet from being supplied in a supply direction, and aligns leading edges of paper sheets when a plurality of paper sheets are stacked.

In the configuration disclosed in JP-A-2000-335769, a shutter is configured to move upward and downward by engaging a rotating cam and a cam follower provided above the tray. Accordingly, a space for rotating the cam is required above the tray, which leads to an increase in the height dimension of the apparatus, or a decrease in the number of paper sheets that can be loaded in the tray.

SUMMARY

A medium feeder according to the present disclosure for solving the above problem includes: a tray configured to contain a medium stacked in an apparatus height direction; a feeding roller that feeds out the medium from the tray; a guide member that faces a leading edge of the medium loaded in the tray and guides the leading edge of the medium fed out from the tray toward downstream in a feed direction; a path blocking member configured to switch between a blocking state that blocks a feed path for a medium fed out from the tray at a position of the guide member, and an open state that opens the feed path; and a switching unit that performs switching of the path blocking member, wherein the switching unit includes a rack configured to be displaced in a feeding direction in which a medium is fed from the tray to thereby perform switching of the path blocking member, and a pinion gear that drives the rack.

DESCRIPTION OF EXEMPLARY EMBODIMENTS

Figure 1:
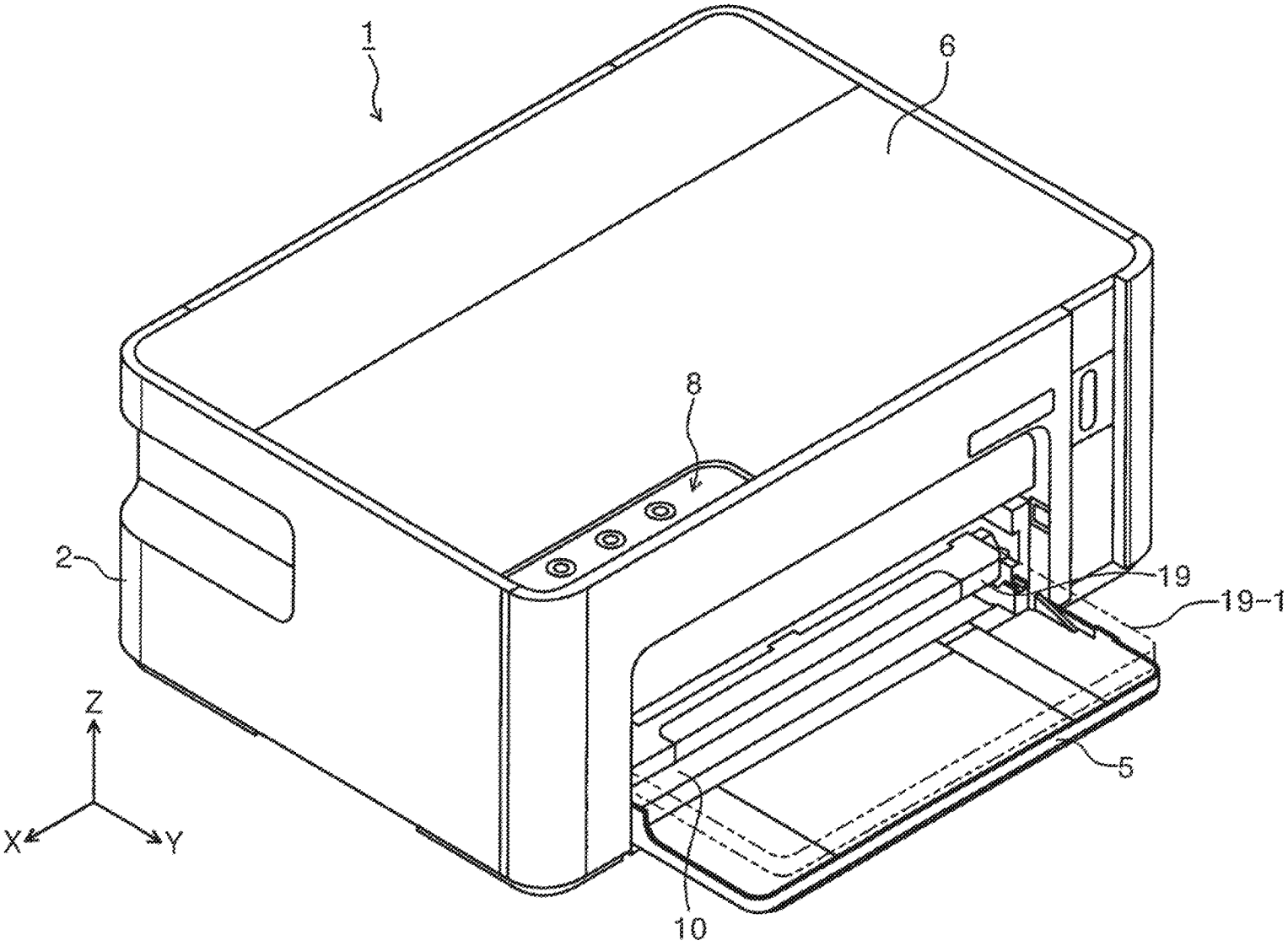
FIG. 1 is a perspective view of an appearance of a printer.

The present disclosure will be schematically described below. A medium feeder according to a first aspect includes: a tray configured to contain a medium stacked in an apparatus height direction; a feeding roller that feeds out the medium from the tray; a guide member that faces a leading edge of the medium loaded in the tray and guides the leading edge of the medium fed out from the tray toward downstream in a feed direction; a path blocking member configured to switch between a blocking state that blocks a feed path for a medium fed out from the tray at a position of the guide member, and an open state that opens the feed path; and a switching unit that performs switching of the path blocking member, wherein the switching unit includes a rack configured to be displaced in a feeding direction in which a medium is fed from the tray to thereby perform switching of the path blocking member, and a pinion gear that drives the rack.

In this configuration, the switching unit that rotates the path blocking member includes a rack configured to be displaced in a feeding direction in which a medium is fed from the tray to thereby perform switching of the path blocking member, and a pinion gear that drives the rack. Accordingly, it is possible to prevent an increase in dimension in the direction perpendicular to the feeding direction, that is, in the apparatus height direction, or a decrease in the number of media that can be loaded in the tray compared with a configuration that rotates the path blocking member by rotation of the cam.

In a second aspect according to the first aspect, the path blocking member may rotate to switch between the blocking state and the open state, the switching unit may include a pressing member that biases the path blocking member toward the open state, and the rack may be displaced between a first position where the path blocking member is maintained in the blocking state against a pressing force from the pressing member and a second position where the path blocking member is allowed to assume the open state.

In a third aspect according to the second aspect, the medium feeder may further includes: a reverse path that reverses a medium fed out from the tray, the reverse path being provided above the tray in the apparatus height direction; and a path forming member that forms at least part of the reverse path, wherein the rack may be displaced along an underside of the path forming member.

With this configuration, since the medium feeder may include: a reverse path that reverses a medium fed out from the tray, the reverse path being provided above the tray in the apparatus height direction; and a path forming member that forms at least part of the reverse path, wherein the rack may be displaced along an underside of the path forming member, a space under the path forming member can be effectively used to prevent an increase in size of the apparatus.

In a fourth aspect according to the third aspect, the medium feeder may further include a roller driving shaft that transmits a rotation torque to the feeding roller, the roller driving shaft being provided under the path forming member in the apparatus height direction, wherein at least part of the pinion gear and at least part of the roller driving shaft may overlap each other in the apparatus height direction.

With this configuration, since the medium feeder may further include a roller driving shaft that transmits a rotation torque to the feeding roller, the roller driving shaft being provided under the path forming member, wherein at least part of the pinion gear and at least part of the roller driving shaft may overlap each other in the apparatus height direction, an increase in the apparatus height direction can be prevented.

In a fifth aspect according to any one of the second to fourth aspects, the feeding roller and the rack may be driven by a power supplied from a common motor. With this configuration, since the feeding roller and the rack may be driven by a power supplied from a common motor, the cost for the apparatus can be reduced.

In a sixth aspect according to the fifth aspect, a clutch mechanism may be provided in a driving force transmission path from the motor to the rack, the clutch mechanism being configured to permit rotation of the motor after the rack reaches a movement limit position. With this configuration, since a clutch mechanism may be provided in a driving force transmission path from the motor to the rack, the clutch mechanism being configured to permit rotation of the motor after the rack reaches a movement limit position, the rack does not interfere with rotation of the feeding roller.

In a seventh aspect according to the fifth or sixth aspect, the path blocking member may move along the feed path when it rotates from the blocking state to the open state at a speed higher than a feeding speed of a medium being fed along the feed path by a feeding force supplied from the feeding roller.

With this configuration, since the path blocking member may move along the feed path when it rotates from the blocking state to the open state at a speed higher than a feeding speed of a medium being fed along the feed path by a feeding force supplied from the feeding roller, it is possible to prevent the leading edge of the paper sheet fed out by the feeding roller from being collapsed when it abuts the path blocking member.

In an eighth aspect according to any one of the fifth to seventh aspects, the medium feeder may further include a delay unit that delays a rotation start timing of the feeding roller from that of the path blocking member when the motor in a stationary state is rotated to switch the path blocking member from the blocking state to the open state.

With this configuration, since the medium feeder may further include a delay unit that delays a rotation start timing of the feeding roller from that of the path blocking member when the motor in a stationary state is rotated to switch the path blocking member from the blocking state to the open state, it is possible to prevent the leading edge of the medium fed out by the feeding roller from being collapsed when it abuts the path blocking member.

A recording apparatus according to a ninth aspect includes: a recording unit that performs recording on a medium; and the medium feeder according to any one of the first to eighth aspects. With this configuration, in the recording apparatus, the advantageous effects of any one of the above first to eighth aspects can be achieved.

In a tenth aspect according to the ninth aspect, the recording apparatus may further include a medium receiving unit that receives a medium outputted after recording is performed, the medium receiving unit being disposed above the tray in the apparatus height direction, wherein at least part of the switching unit may overlap the medium receiving unit in the apparatus height direction. With this configuration, since the recording apparatus may further include a medium receiving unit that receives a medium outputted after recording is performed, the medium receiving unit being disposed above the tray, wherein at least part of the switching unit may overlap the medium receiving unit in the apparatus height direction, an increase in the apparatus height direction can be prevented.

With reference to the drawings, the above aspects will be described below. In the following description, an ink jet printer that performs ink jet recording onto a paper sheet, which is an example of a medium, will be described as an example of the recording apparatus. Hereinafter, an ink jet printer is simply referred to as a "printer." The X-Y-Z coordinate system indicated in the drawings is Cartesian coordinate system, in which the X axis direction is an apparatus width direction and a paper sheet width direction, the Y axis direction is a paper sheet transport direction during recording being performed onto the paper sheet and an apparatus depth direction, and the Z direction is an apparatus height direction and the vertical direction. A direction in which the paper sheet is fed and transported may also be referred to as a "downstream direction," and a direction opposite the downstream direction may also be referred to as an "upstream direction."

In FIG. 1, a printer 1 includes an apparatus main body 2. On the top of the apparatus main body 2, an upper cover 6 and an operation unit 8 are provided. Further, a front cover 5 is provided on the front side of the apparatus main body 2. The front cover 5 is rotatable relative to a paper sheet tray 10, which is detachably attached to the apparatus main body 2. The front cover 5 can be removed from the apparatus main body 2 together with the paper sheet tray 10.

The front cover 5 openably covers the front side of the apparatus main body 2, and can assume a closed state (not shown) and an open state shown in FIG. 1. When the front cover 5 is in the open state, paper sheets can be added onto the paper sheet tray 10 while the paper sheet tray 10 remains attached to the apparatus main body 2. Further, when the front cover 5 is in the open state, paper sheets on which recording has been performed can be outputted onto an output tray 19. The paper sheet tray 10 is an example of a tray on which paper sheets can be stacked in an apparatus height direction, and the output tray 19 is an example of a paper sheet receiving unit that receives paper sheets outputted after recording has been performed.

Figure 2:
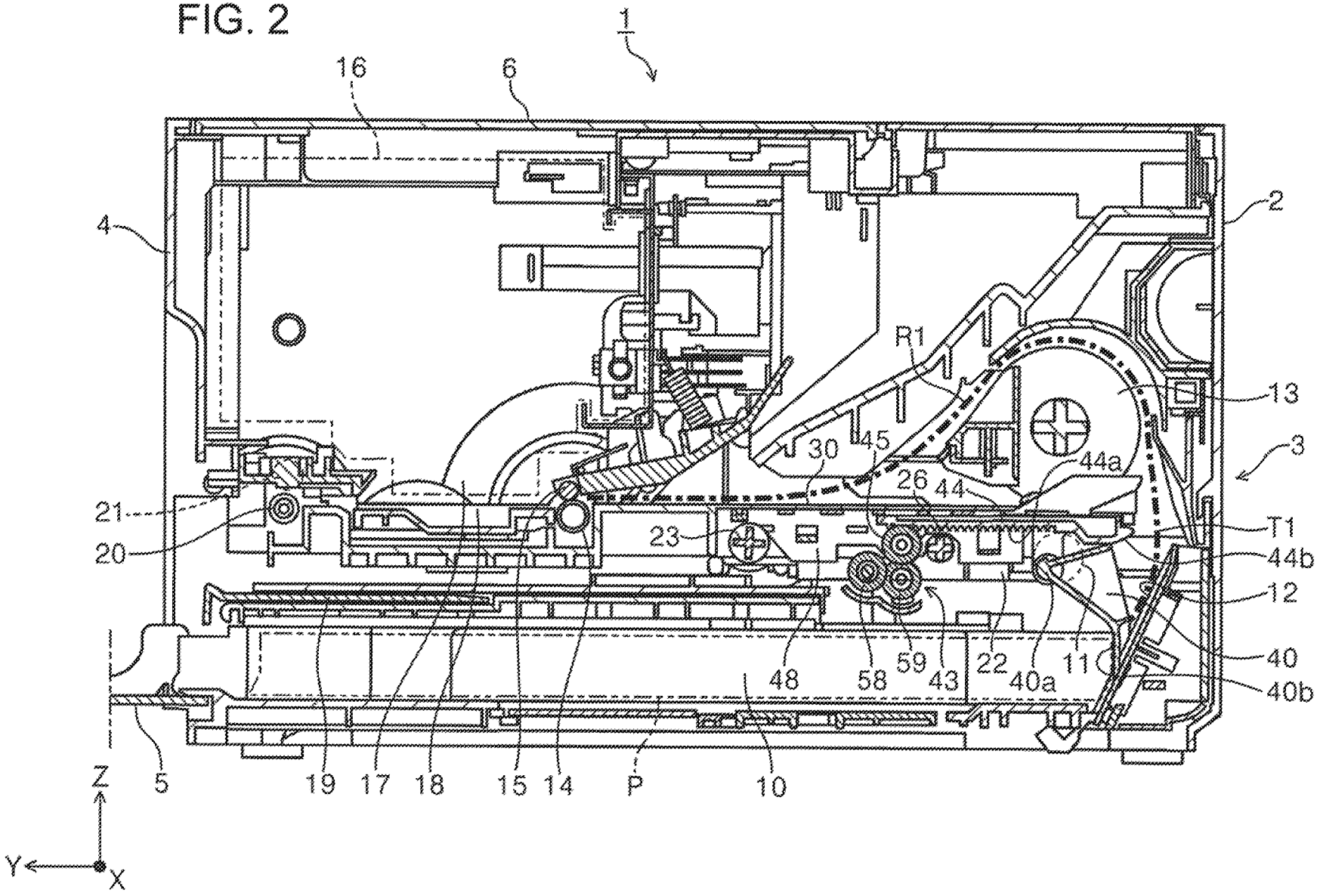
FIG. 2 is a view illustrating a paper sheet transport path in the printer.
Figure 3:
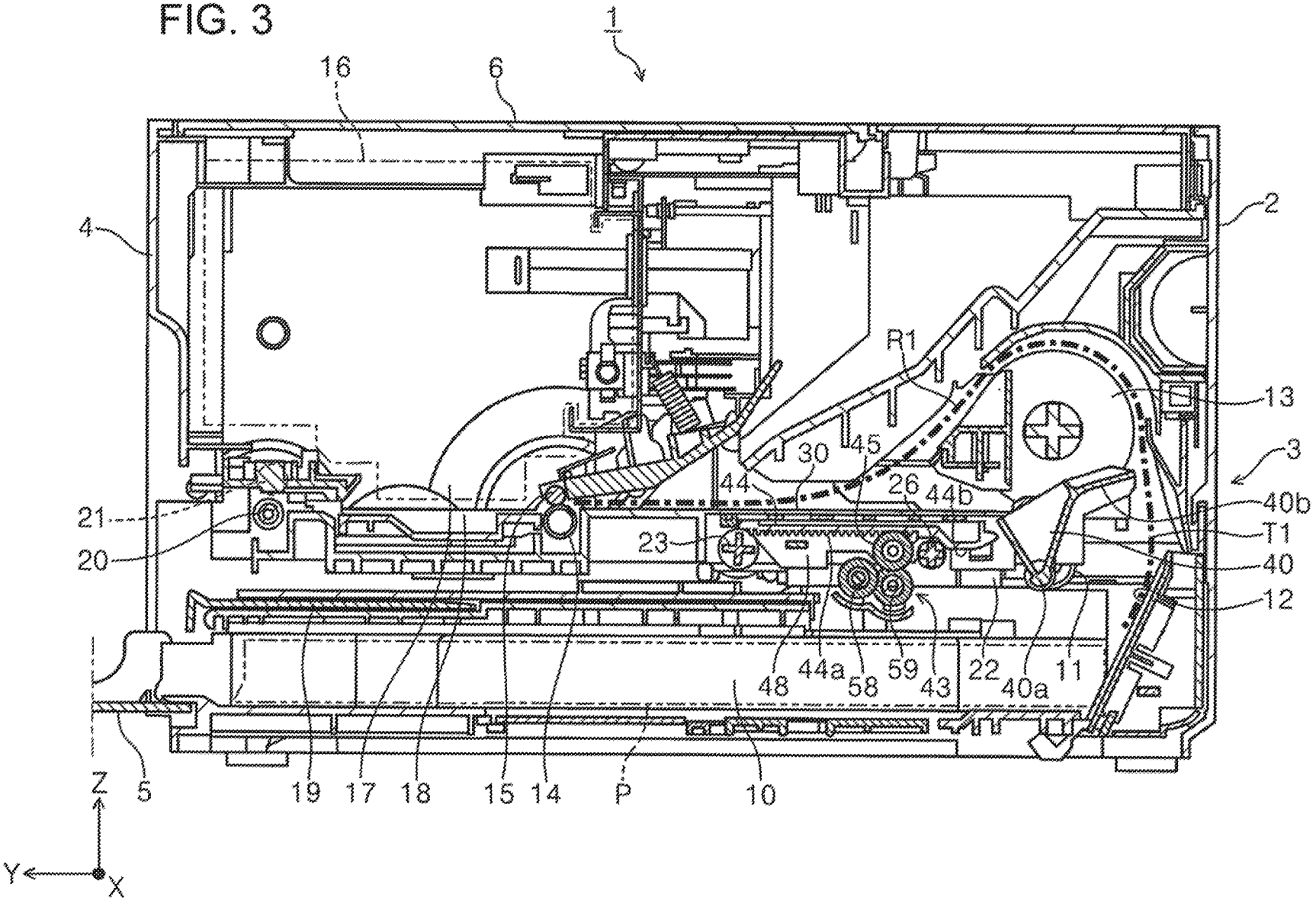
FIG. 3 is a view illustrating a paper sheet transport path in the printer.

The output tray 19 is configured to switch between an accommodated state in which it is accommodated in the apparatus main body 2 as shown in FIGS. 1 to 3 and a pulled-out state in which it is pulled out from the apparatus main body 2 in the +Y direction by an operation of the user as indicated by the dot-dot-dashed line and reference numeral 19-1 in FIG. 1.

The upper cover 6 provided on the top of the apparatus openably covers the apparatus, and can assume a closed state and an open state (not shown). When the upper cover 6 is in the open state, the inside of the apparatus main body 2 is exposed so that a jam clearing operation, an ink injection work, and the like can be performed. Further, on the top of the apparatus, the operation unit 8 is provided through which various operations of the printer 1 are operated. On and off operation of the power supply of the apparatus and various settings can be performed through the operation unit 8.

With reference to FIGS. 2 and 3, a feed path and a transport path of the paper sheets in the printer 1 will now be described. The paper sheet tray 10 is disposed on the bottom of the apparatus, and a paper sheet is fed out from the paper sheet tray 10 by a feeding roller 11. The paper sheet feeding direction by the feeding roller 11 is the −Y direction. Although the details are described later, the feeding roller 11 is configured to be advanced to and retracted from the paper sheets loaded in the paper sheet tray 10. The paper sheet fed out from the paper sheet tray 10 is fed by the reverse roller 13 toward the transport driving roller 14 and the transport driven roller 15.

Figure 7:
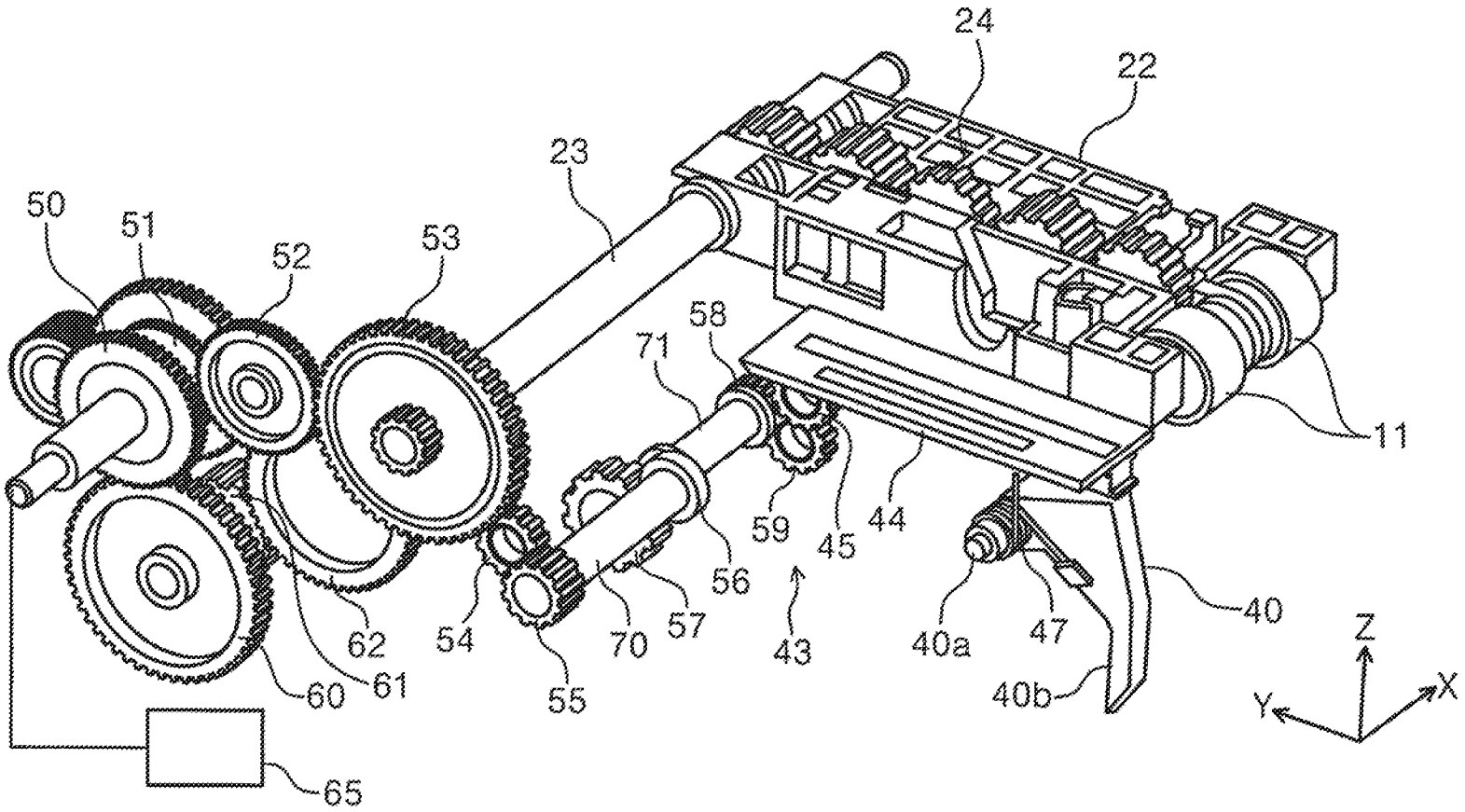
FIG. 7 is a perspective view of a path blocking member and a rotation unit.

The feeding roller 11 and the reverse roller 13 are driven by a motor 65 (see FIG. 7). Reference numeral T1 indicates a feed path of a paper sheet that is picked up and fed from the paper sheet tray 10. The paper sheet feed path T1 is a path extending from the feeding roller 11 to the transport driving roller 14 and the transport driven roller 15. The paper sheet feed path T1 includes a reverse path R1 that reverses the paper sheet fed out from the paper sheet tray 10. The reverse path R1 is a path extending from the reverse roller 13 to the transport driving roller 14 and the transport driven roller 15. A portion of the reverse path R1, more specifically, a path adjacent to a region upstream of the transport driving roller 14 and the transport driven roller 15 is formed by the path forming member 30. In the present embodiment, the path forming member 30 extends in the Y axis direction.

In FIGS. 2 and 3, reference numeral P and the dot-dot-dashed line indicate a paper sheet loaded in the paper sheet tray 10. A guide member 12 is provided at a position facing the −Y direction edge of the paper sheet loaded in the paper sheet tray 10. The guide member 12 guides the leading edge of the paper sheet fed out from the paper sheet tray 10 to be fed downstream. In the present embodiment, the guide member 12 is formed as a high friction surface, and promotes separation of the paper sheet when they are fed downstream with the leading edge being in contact with the guide member 12.

Figure 4:
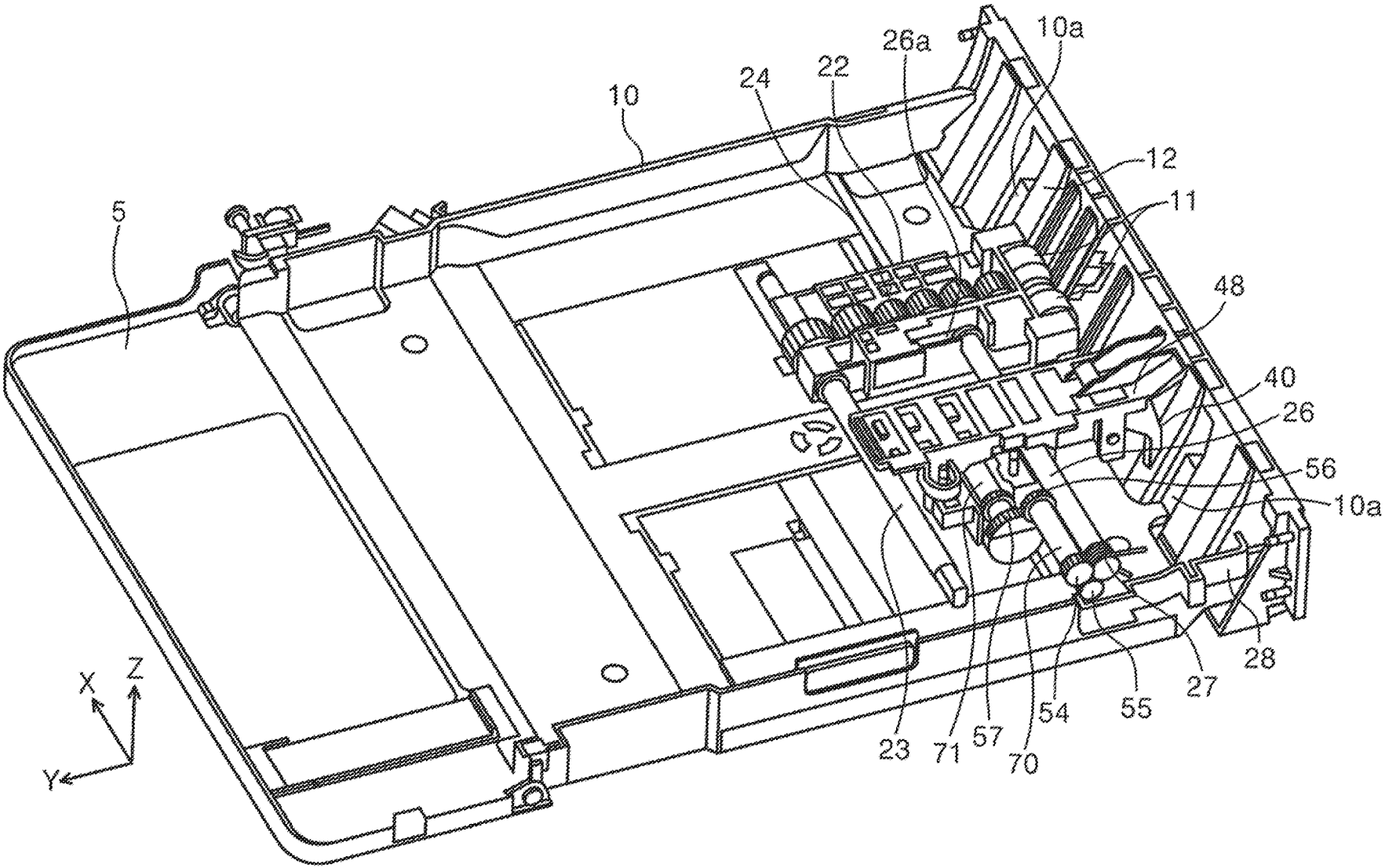
FIG. 4 is a perspective view of a paper sheet tray and a guide member.
Figure 5:
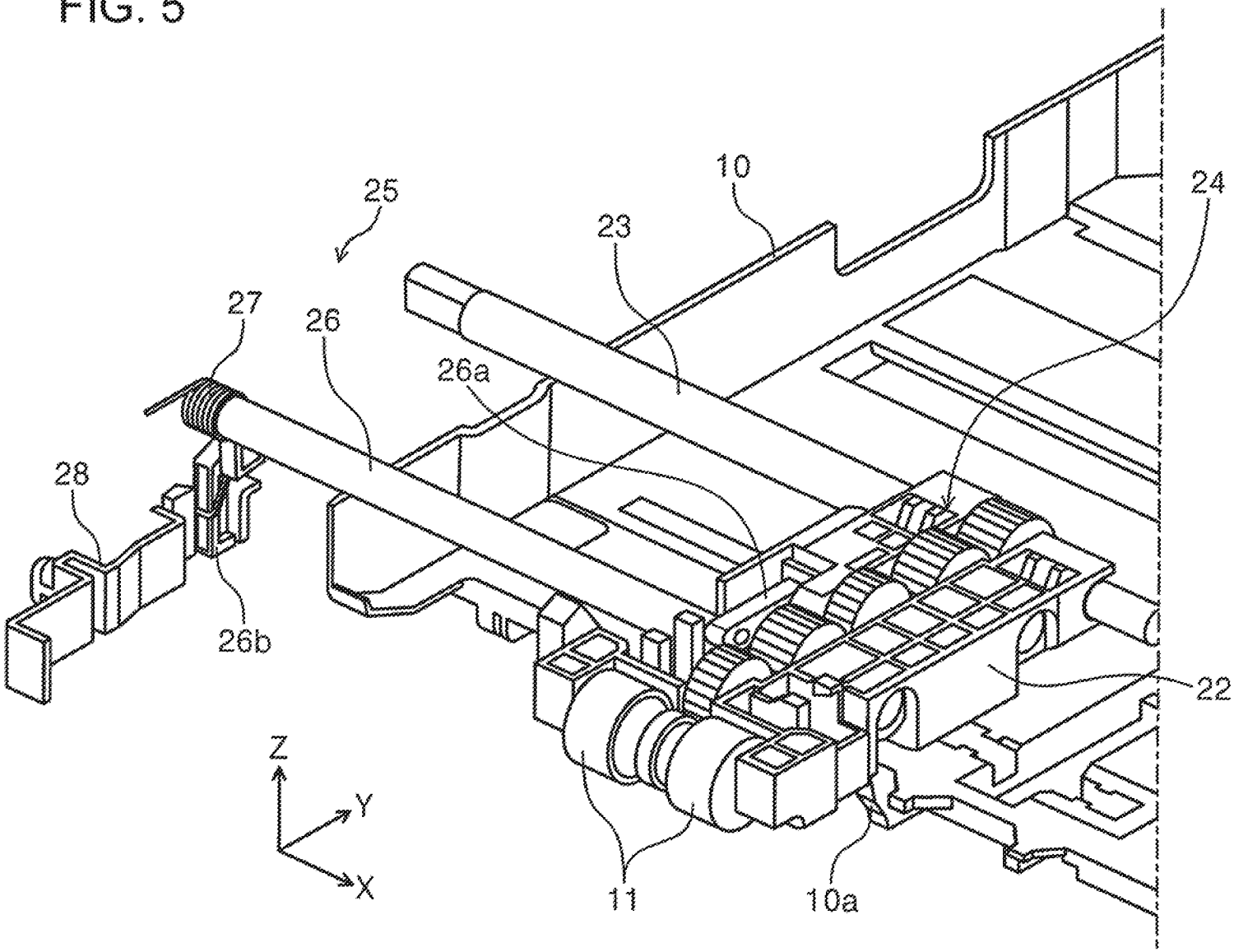
FIG. 5 is a perspective view of a paper sheet tray and a swing regulation unit.
Figure 6:
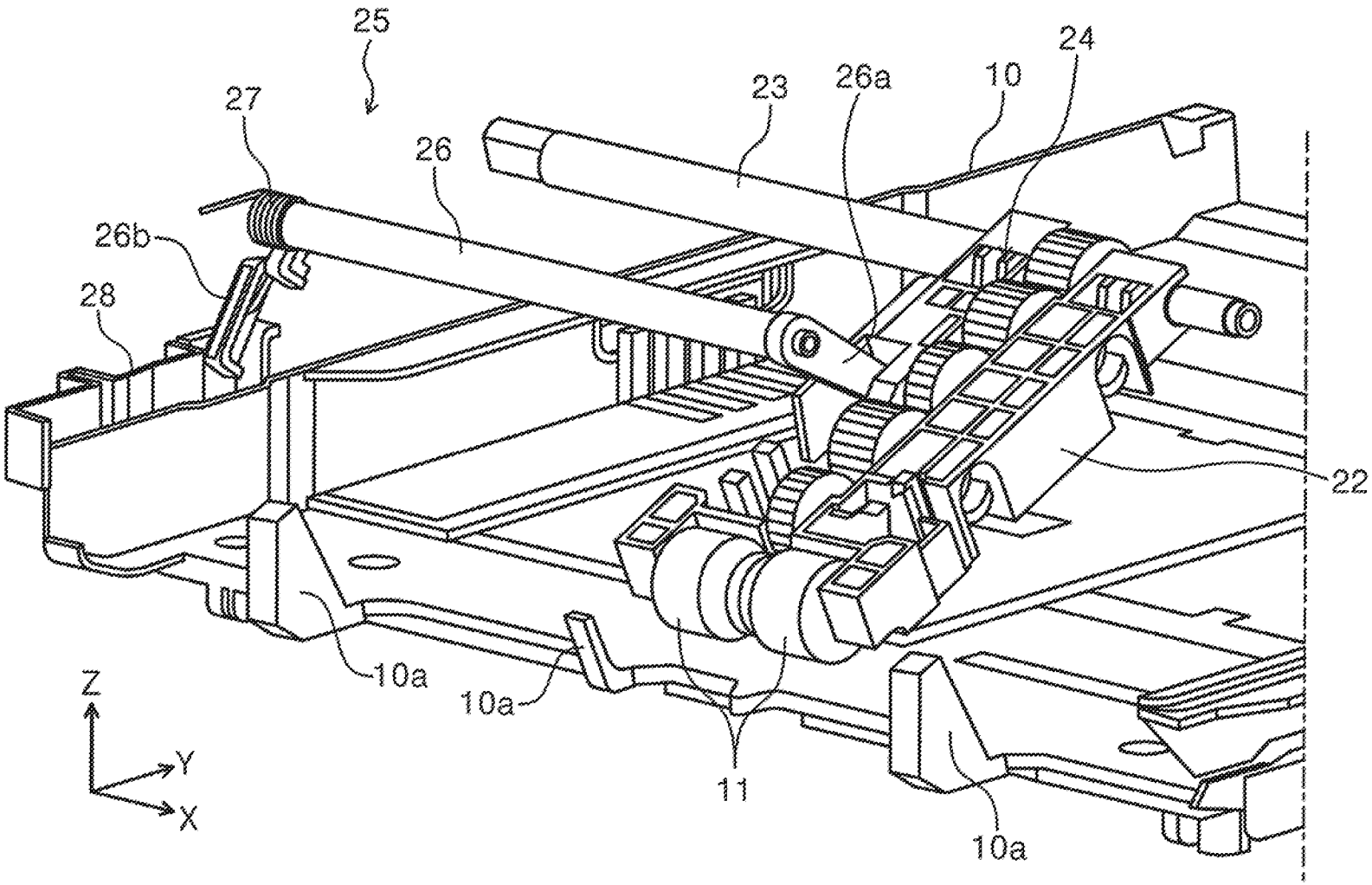
FIG. 6 is a perspective view of a paper sheet tray and a swing regulation unit.

As shown in FIGS. 4 to 6, a stopper 10*a* is disposed at the −Y direction end of the paper sheet tray 10. In loading of paper sheets into the paper sheet tray 10 while the paper sheet tray 10 is removed from the apparatus main body 2, the stopper 10*a* regulates the paper sheets so that they do not protrude from the paper sheet tray 10 in the −Y direction. When the paper sheet tray 10 is attached to the apparatus main body 2, the stopper 10*a* is located in the −Y direction from the guide member 12. With this configuration, the leading edge of the paper sheet abuts the guide member 12 rather than the stopper 10*a* when the paper sheet is fed out.

A path blocking member 40 is provided adjacent to the guide member 12. The path blocking member 40 is rotatable about a rotation shaft 40*a* having a rotation axis parallel to the X axis direction, and the path blocking member 40 rotates to switch between a blocking state (see FIG. 2) that blocks the paper sheet feed path T1 at a position of the guide member 12 and an open state (see FIG. 3) that opens the paper sheet feed path T1. The path blocking member 40 assumes the blocking state before feeding of paper sheets. In this state, when the paper sheets are added into the paper sheet tray 10 while the paper sheet tray 10 is attached to the apparatus main body 2, the leading edges of the paper sheets are prevented from being pushed onto the upper portion of the guide member 12, and thus double feeding of the paper sheets are prevented.

Moreover, when rotating from the open state to the blocking state, the path blocking member 40 can push the leading edge of the paper sheet which has been put on the upper portion of the guide member 12 back into the paper sheet tray 10. That is, the path blocking member 40 also serves as a paper sheet returning unit. In feeding of a plurality of paper sheets, the path blocking member 40 is switched from the blocking state to the open state to feed the first paper sheet, and remains in the open state until feeding of the last paper sheet is completed. After the trailing edge of the last paper sheet has passed through the path blocking member 40, the path blocking member 40 is switched from the open state to the blocking state. The details of a switching unit 43 that performs switching of the path blocking member 40 will be described later.

Figure 10:
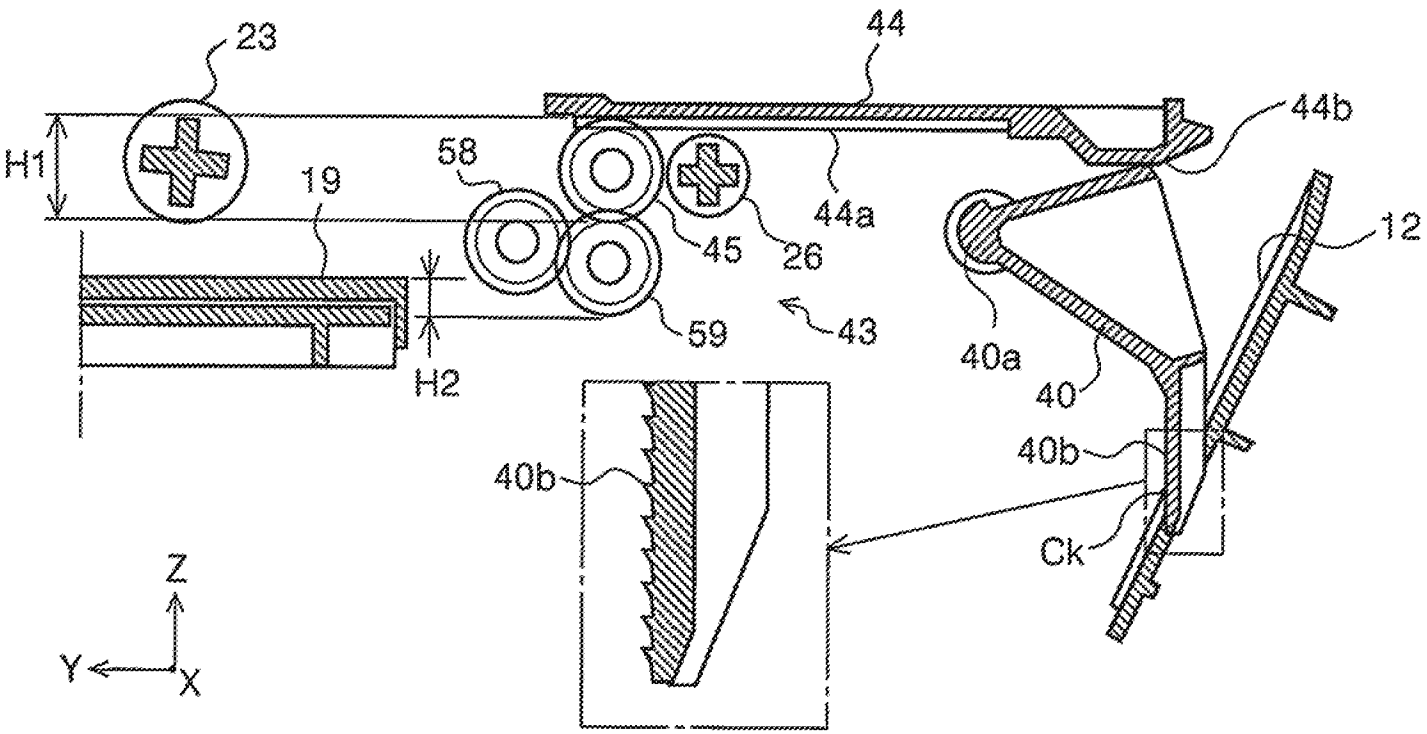
FIG. 10 is a side view of a path blocking member.

Further, the path blocking member 40 includes an abutment member 40*b*. When the path blocking member 40 is in the blocking state, the abutment member 40*b* hangs down substantially vertically as shown in FIG. 10, and engages with the guide member 12. As a consequence, the paper sheet feed path T1 is completely blocked. As shown in the enlarged view in FIG. 10, a surface of the abutment member 40*b* extending in the vertical direction that faces a paper sheet has asperities. Accordingly, when the leading edge of the paper sheet abuts the abutment member 40*b*, the paper sheet is reliably prevented from being advanced upward.

The paper sheet tray 10, the feeding roller 11, the reverse roller 13, the guide member 12, the path forming member 30, and the path blocking member 40, described above, constitute the paper sheet feeder 3.

The paper sheet that has reached the transport driving roller 14 and the transport driven roller 15 is transported to a position under a recording head 17, which an example of a recording unit, by the transport driving roller 14 and the transport driven roller 15. In FIGS. 2 and 3, the recording head 17 and the carriage 16 are indicated by the dot-dot-dashed line. The transport driving roller 14 is a roller that is driven by a motor (not shown), and the transport driven roller 15 is a roller driven by the transport driving roller 14. The paper sheet transport direction by the transport driving roller 14 and the transport driven roller 15 is a paper sheet transport direction during recording, which is the +Y direction.

The recording head 17 is an ink jet recording head disposed on the bottom of the carriage 16. The carriage 16 reciprocates in a paper sheet width direction (X axis direction), which is a direction perpendicular to a direction (+Y direction) in which paper sheet is transported during recording, and performs recording by ejecting ink from the recording head 17 while reciprocating. A support member 18 is provided at a position facing the recording head 17, and the paper sheet fed downstream by the transport driving roller 14 and the transport driven roller 15 is supported by the support member 18.

After recording is performed by the recording head 17, the paper sheet is nipped between an output driving roller 20 and an output driven roller 21, which are disposed downstream of the recording head 17 in the paper sheet transport path, and outputted in the +Y direction. The output driving roller 20 is a roller driven by a motor (not shown), and the output driven roller 21 is a roller driven by rotation of the output driving roller 20.

Next, the details of the paper sheet feeder 3 will be described. As shown in FIGS. 4 to 6, the feeding roller 11 is supported by the swing member 22. In the present embodiment, two feeding rollers 11 are provided for the swing member 22. The swing member 22 is swingable about a roller driving shaft 23 that transmits a rotation torque of the motor 65 (see FIG. 7) to the feeding rollers 11. As the swing member 22 swings, the feeding rollers 11 are advanced to and retracted from the paper sheets loaded in the paper sheet tray 10. The roller driving shaft 23 is a shaft having an axis line in the X axis direction. Power from the roller driving shaft 23 is transmitted to the feeding roller 11 via a gear train 24.

The swing member 22 switch between a state in which swing is regulated by a swing regulation unit 25 shown in FIGS. 5 and 6 (state shown in FIGS. 4 and 5) and a state in which such regulation is released (state shown in FIG. 6). In the state in which regulation is released, the feeding rollers 11 can be in contact with the paper sheet loaded in the paper sheet tray 10. In the state in which swing of the swing member 22 is regulated, the feeding rollers 11 is spaced upward from the paper sheets loaded in the paper sheet tray 10.

In FIGS. 5 and 6, the swing regulation unit 25 is composed of a rotation shaft 26, a slide member 28, a torsion spring 27 as a pressing member. The rotation shaft 26 is a shaft having an axis line in the X axis direction. A swing regulation member 26*a* is provided on the +X direction end of the rotation shaft 26, and an engaging member 26*b* is provided on the −X direction end of the rotation shaft 26. The swing regulation member 26*a* is engageable with the swing member 22, and the engaging member 26*b* is engageable with the slide member 28.

The torsion spring 27 is provided on the rotation shaft 26. Due to a spring force of the torsion spring 27, a state shown in FIG. 5, that is, a state in which the swing regulation member 26*a* lifts the swing member 22 upward, is maintained while the rotation shaft 26 is not subjected to an external force, specifically, when the paper sheet tray 10 is not attached. That is, swing of the swing member 22 is regulated, and the feeding roller 11 is spaced upward from the paper sheets loaded in the paper sheet tray 10.

The slide member 28 is slidable in the Y axis direction, that is, in a direction in which the paper sheet tray 10 is detachably attached. When the paper sheet tray 10 is not attached, the slide member 28 is biased in the +Y direction by the engaging member 26*b* as shown in FIG. 5. The slide member 28 is engageable with the paper sheet tray 10, and, when the paper sheet tray 10 is attached, pushed in the −Y direction by the paper sheet tray 10 as shown by change from FIG. 5 to FIG. 6. As the slide member 28 slides in the −Y direction, the slide member 28 rotates the rotation shaft 26 via the engaging member 26*b*. Accordingly, the swing regulation member 26*a* provided on the rotation shaft 26 moves downward as shown by change from FIG. 5 to FIG. 6, that is, a state in which it supports the swing member 22 is released. As a consequence, swing regulation state of the swing member 22 is released, which causes the swing member 22 to swing by its own weight. Accordingly, the feeding roller 11 is displaced downward and comes into contact with the paper sheet.

As shown in FIG. 4, the path blocking member 40 is provided on the −X direction side of the swing member 22. The path blocking member 40 is provided on a support member 48 so as to be rotatable about the rotation shaft 40*a* as shown in FIGS. 2, 3, 8, and 9. In the present embodiment, the rotation axis of the rotation shaft 40*a* is parallel to the X axis. Further, a rack member 44 is provided on the support member 48 so as to be slidable in the Y axis direction. The rack member 44 has a rack section 44*a* on the underside thereof, which meshes with a pinion gear 45 to form a rack pinion mechanism. That is, as the pinion gear 45 rotates, the rack member 44 slides in the Y axis direction.

Figure 8:
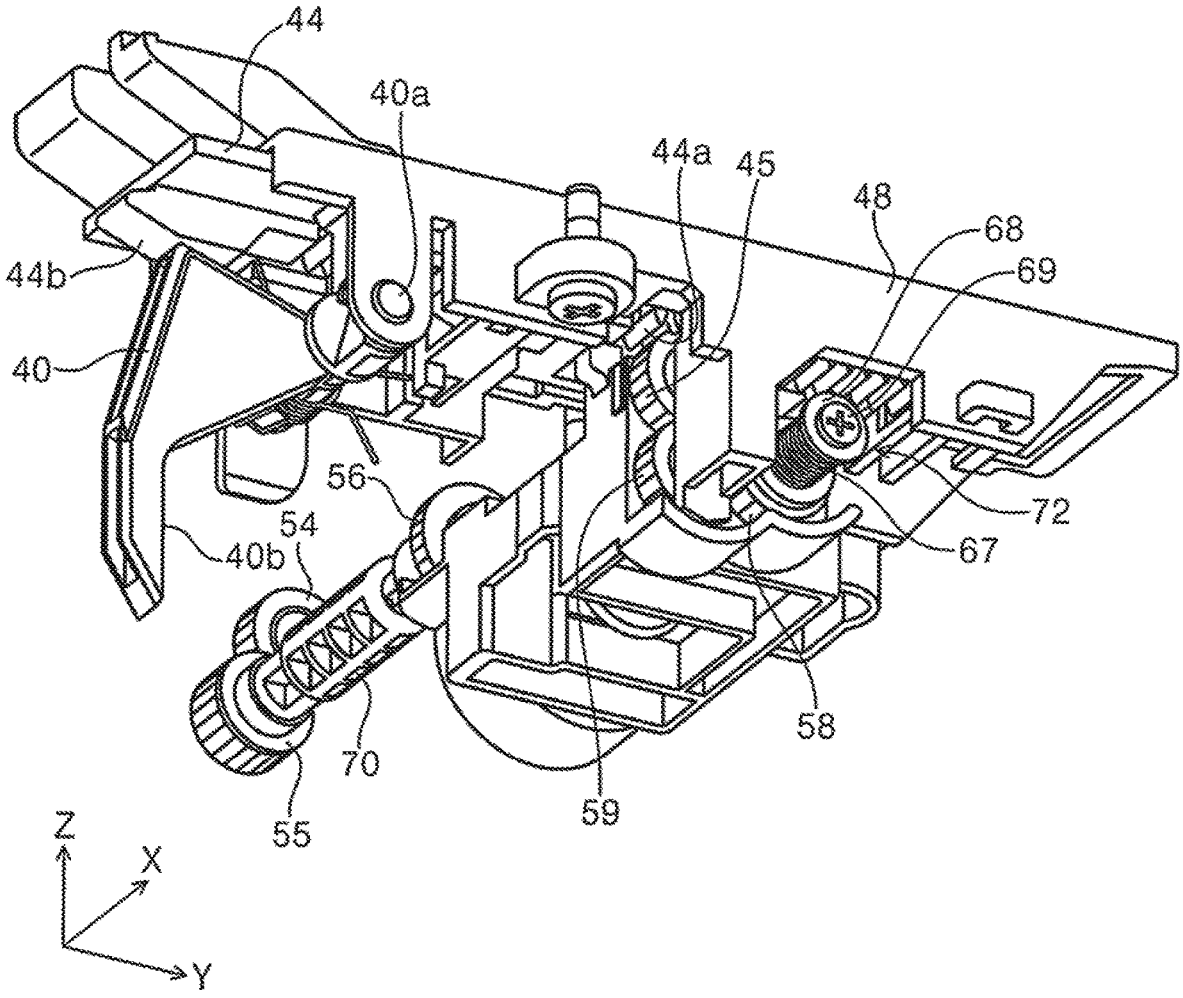
FIG. 8 is a perspective view of a path blocking member and a clutch mechanism.

Further, the rack member 44 has a cam section 44*b* on the underside thereof at the −Y direction end. The cam section 44*b* is engageable with the path blocking member 40. The path blocking member 40 is subjected to a spring force from the torsion spring 47, which is an example of the pressing member such that the path blocking member 40 is biased in a direction in which it assumes the open state (see FIG. 9). As shown in FIG. 8, the cam section 44*b* serves to maintain the path blocking member 40 in the blocking state against the spring force from the torsion spring 47.

Figure 9:
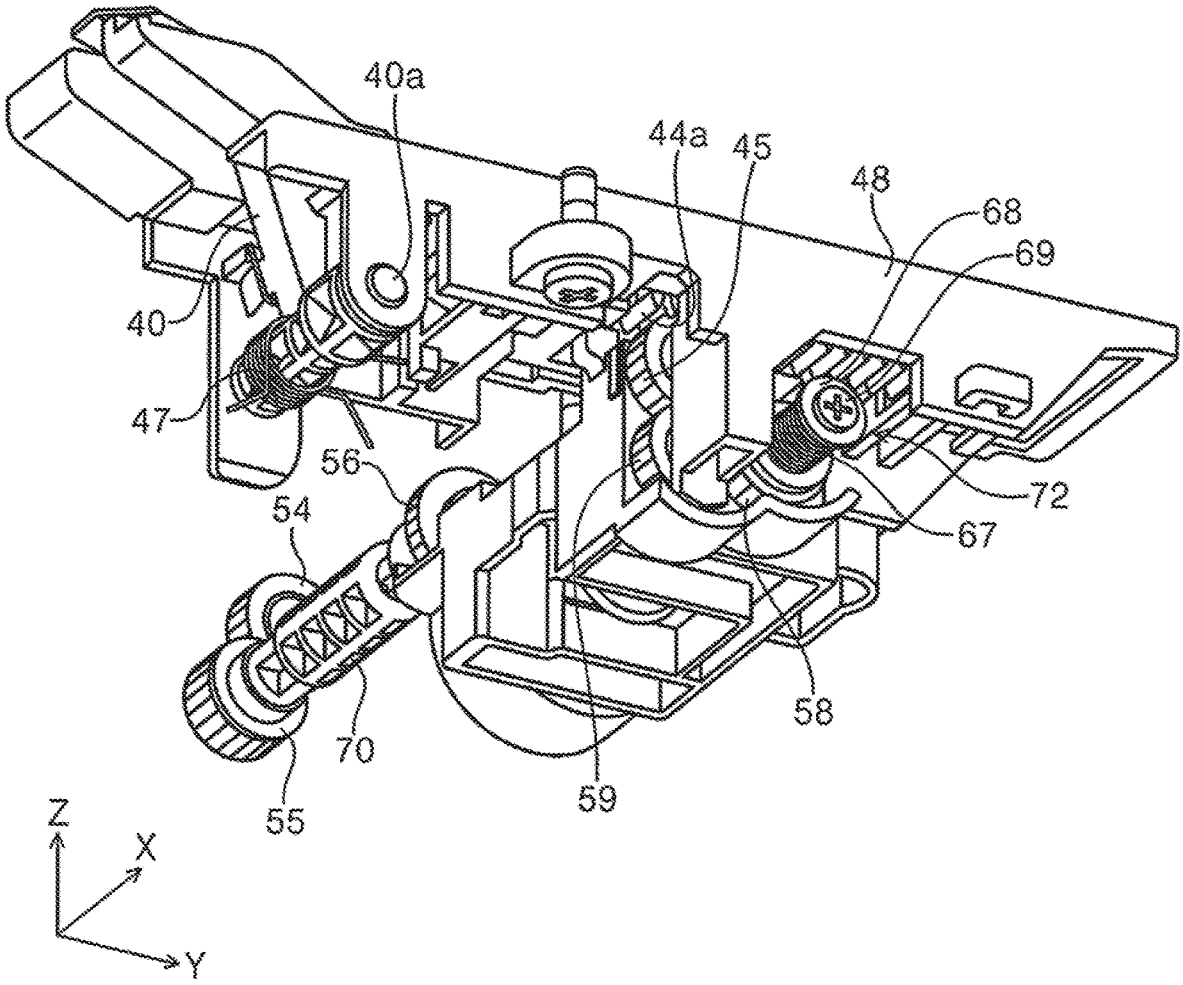
FIG. 9 is a perspective view of a path blocking member and a clutch mechanism.

The position of the rack member 44 shown in FIGS. 2 and 8 is an example of a first position, which is an example of a position where the path blocking member 40 is maintained in the blocking state against the spring force from the torsion spring 47. When the rack member 44 moves from the first position in the +Y direction, restraint by the cam section 44*b* to the position of the path blocking member 40 is released. Accordingly, as shown in FIG. 9, the path blocking member 40 changes from the blocking state to the open state. The position of the rack member 44 shown in FIGS. 3 and 9 is an example of a second position. In the second position, the rack member 44 permits the path blocking member 40 to assume the open state.

As the rack member 44 moves from the second position in the −Y direction, the cam section 44*b* pushes down the path blocking member 40 against the spring force from the torsion spring 47. Accordingly, the path blocking member 40 changes from the open state to the blocking state. As described above, as the rack member 44 is displaced in the paper sheet feeding direction from the paper sheet tray 10, that is, in the Y axis direction, the displacement movement is converted into the rotation movement of the path blocking member 40.

Then, a mechanism of rotating the pinion gear 45 meshing with the rack section 44*a* of the rack member 44, in other words, the switching unit 43 that performs switching of the path blocking member 40 will be described. In FIG. 7, the switching unit 43 includes the pinion gear 45 that meshes with the rack section 44*a* of the above rack member 44, the above torsion spring 47, a plurality of shafts, and a plurality of gears. Specifically, the switching unit 43 includes gears 51, 52, 53, 54, 55, 56, 57, 58, and 59, and rotation shafts 70 and 71. Of these elements, the gear 57 is integrally formed with the rotation shaft 71 on the −X direction end of the rotation shaft 71, and the gear 58 is formed rotatable relative to the rotation shaft 71 on the +X direction end of the rotation shaft 71. The details of mounting structure of the gear 58 will be described later.

The gear 51 is a gear that integrally rotates with the gear 50, and a driving force of the motor 65 is transmitted to the gear 50 via gear, which is not shown in FIG. 7. The gear 50 meshes with the gear 60, and a driving force of the motor 65 is transmitted from the gear 60 to the roller driving shaft 23 via the gears 61 and 62. The roller driving shaft 23 is a shaft that transmits a rotation torque to the feeding roller 11 as described above. That is, the feeding roller 11 and the path blocking member 40 use the motor 65 as a common driving source. Further, a delay unit 75 (see FIG. 12) is provided between the gear 60 and the gear 61, which will be described in detail later.

When a rotation direction of the motor 65 in which the feeding roller 11 feeds a paper sheet from the paper sheet tray 10 is defined as a forward rotation direction, and a rotation direction opposite to the forward rotation direction is defined as a reverse rotation direction, the rack member 44 is displaced in the +Y direction, that is, displaced toward the second position by forward rotation of the motor 65, and the path blocking member 40 is switched from the blocking state to the open state. The rack member 44 is displaced to the −Y direction, that is, toward the first position by reverse rotation of the motor 65, and the path blocking member 40 is switched from the open state to the blocking state. Further, a one-way clutch (not shown) is provided in a driving force transmission path to the feeding roller 11. Accordingly, even when the motor 65 rotates in reverse direction, the rotation torque is not transmitted to the feeding roller 11, and the feeding roller 11 does not rotate in reverse direction.

Figure 11:
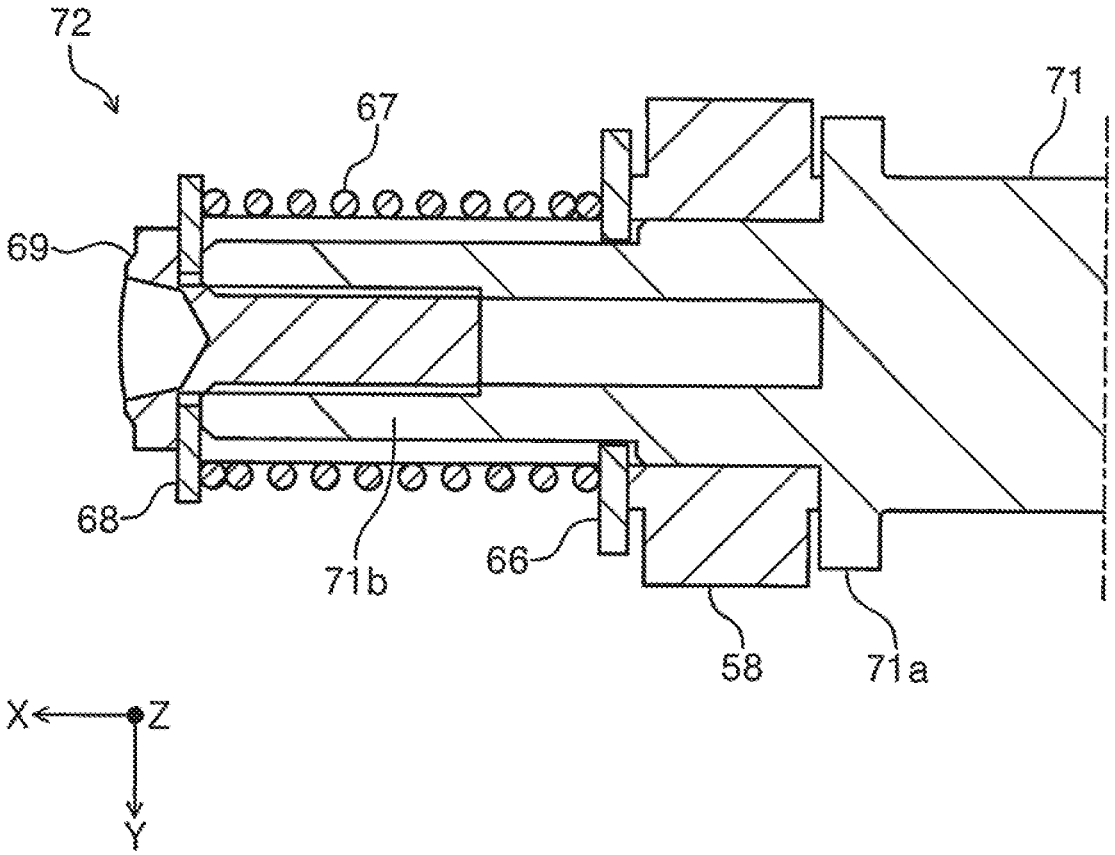
FIG. 11 is a cross-sectional view of a clutch mechanism.

A clutch mechanism 72 is disposed in a driving force transmission path from the motor 65 to the rack member 44. The clutch mechanism 72 permits rotation of the motor 65 after the rack member 44 reaches a movement limit position, specifically, the first position or the second position. Referring to FIG. 11, the clutch mechanism 72 will now be described. The clutch mechanism 72 includes a friction member 66, a compression spring 67 as an example of a pressing member, a washer 68, and a screw 69. As shown in FIG. 11, a flange 71*a* is provided near the +X direction end of the rotation shaft 71, which is described in connection with FIG. 7, and a shaft end 71*b* is provided on the +X direction side of the flange 71*a*. The gear 58 described in connection with FIG. 7 is fit on the shaft end 71*b* shown in FIG. 11, and is rotatable relative to the shaft end 71*b*.

The compression spring 67 exerts a spring force between the washer 68 fixed by the screw 69 and the friction member 66, and biases the friction member 66 in the −X direction. Accordingly, the gear 58 is also biased in the −X direction, and pressed against the flange 71*a*. In this configuration, as the rotation shaft 71 rotates, the gear 58 rotates together with the rotation shaft 71 by a friction force between the gear 58 and the friction member 66, and a friction force between the gear 58 and the flange 71*a*. Since the gear 58 is configured to transmit the rotation torque to the pinion gear 45 that constitutes the rack pinion mechanism (see FIG. 7), the gear 58 stops rotating when the rack member 44 reaches the second position due to the motor 65 rotating in the forward direction. However, since the rotation shaft 71 transmits the rotation torque to the gear 58 via a friction force, the rotation shaft 71, that is, the motor 65 can continue to rotate. This applies to the reverse direction, and, when the rack member 44 reaches the first position due to the motor 65 rotating in the reverse rotation, the gear 58 stops rotating. However, since the rotation shaft 71 transmits the rotation torque to the gear 58 via a friction force, the rotation shaft 71, that is, the motor 65 can continue to rotate. By virtue of the above configuration, a common driving source can be provided for the feeding roller 11 and the path blocking member 40 without requiring a precise phase control.

Figure 12:
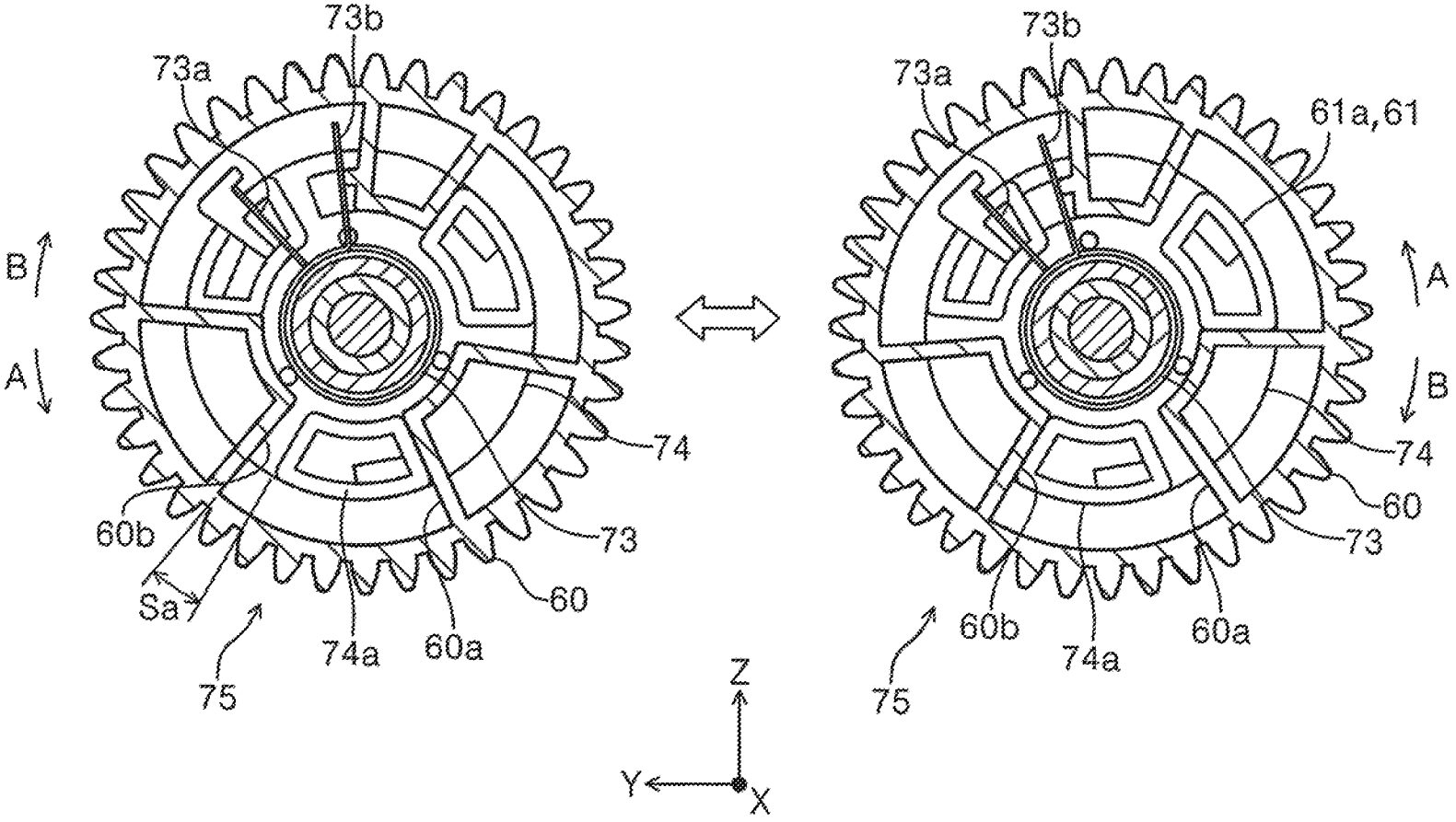
FIG. 12 is a cross-sectional view of a delay unit.

With reference to FIG. 12, a delay unit 75 will be described. The delay unit 75 is configured to delay a rotation start timing of the feeding roller 11 from that of the path blocking member 40 when the motor 65 in a stationary state starts rotating in the forward direction. In FIG. 12, reference numeral 74 is a rotator integrally formed with the gear 61 shown in FIG. 7, and rotates integrally with the gear 61. The rotator 74 includes a transmitted section 74*a* formed therein, and the transmitted section 74*a* is slightly movable between transmitting sections 60*a* and 60*b* formed inside the gear 61. In the present embodiment, a plurality of transmitted sections 74*a* are arranged in a circumferential direction, and a plurality of transmitting sections 60*a* and 60*b* are also arranged in a circumferential direction. However, in order to avoid complicated illustration, only one element for each of these is denoted by reference numeral in FIG. 12.

The delay unit 75 includes a torsion spring 73, which is an example of a pressing member, and the torsion spring 73 generates a pressing force between the rotator 74 and the gear 60. In FIG. 12, the arrow A indicates a rotation direction of the gear 60 in which the motor 65 rotates in the forward direction, that is, the feeding roller 11 feeds the paper sheet from the paper sheet tray 10, and the arrow B indicates a rotation direction opposite to that indicated by the arrow A. The left view of FIG. 12 illustrates the motor 65 in a stationary state. In this state, a gap Sa is formed and maintained between the transmitted section 74*a* and the transmitting section 60*b* due to a spring force from the torsion spring 73. In this state, the transmitted section 74*a* is in contact with the transmitting section 60*a*. Accordingly, when the motor 65 rotates in the reverse direction, which causes the gear 60 to rotate in the arrow B direction, the rotator 74 immediately rotates. However, since the one-way clutch (not shown) is provided as described above, the feeding roller 11 remains stationary and does not rotate in the reverse direction even when the motor 65 rotates in the reverse direction.

On the other hand, when the gear 65 rotates in the arrow A direction by forward rotation of the motor 65 from the state shown in the left view of FIG. 12, the rotator 74, that is, the feeding roller 11 does not immediately rotate due to the gap Sa being formed, and only the gear 60 rotates until it has moved across the gap Sa. As the gear 60 has moved across the gap Sa, the transmitting section 60*b* abuts the transmitted section 74*a*, which allows the gear 60 to transmit the rotation torque to the rotator 74, that is, the feeding roller 11 as shown in the right view of FIG. 12. That is, the delay unit 75 delays the rotation start timing of the feeding roller 11 from that of the path blocking member 40 when the motor 65 in the stationary state starts rotating in the forward direction.

As described above, the paper sheet feeder 3 includes: the paper sheet tray 10 configured to contain paper sheets stacked in an apparatus height direction; the feeding roller 11 that feeds out the paper sheet from the paper sheet tray 10; the guide member 12 that faces a leading edge of the paper sheet loaded in the paper sheet tray 10 and guides the leading edge of the paper sheet fed out from the paper sheet tray 10 toward downstream in a feed direction; the path blocking member 40 configured to switch between a blocking state that blocks a feed path for a paper sheet fed out from the paper sheet tray 10 at a position of the guide member 12, and an open state that opens the feed path; and the switching unit 43 that performs switching of the path blocking member 40. The switching unit 43 includes the rack member 44 configured to be displaced in a feeding direction in which the paper sheet is fed from the paper sheet tray 10 to thereby perform switching of the path blocking member 40, and the pinion gear 45 that drives the rack member 44. With this configuration, it is possible to prevent an increase in dimension in the apparatus height direction, or a decrease in the number of paper sheets that can be loaded in the paper sheet tray 10 compared with a configuration that rotates the path blocking member 40 by rotation of the cam. Further, the path blocking member 40 includes the abutment member 40*b*, and the abutment member 40*b* as viewed in the rotation axis direction of the path blocking member 40 engages with the guide member 12 when the path blocking member 40 is in the blocking state. As a consequence, the paper sheet feed path T1 is completely blocked. Further, the abutment member 40*b* has asperities on the surface facing the paper sheet. Accordingly, when the leading edge of the paper sheet abuts the abutment member 40*b*, the paper sheet is reliably prevented from being advanced upward in the apparatus height direction. Further, the switching unit 43 includes a plurality of shaft and a plurality of gears.

In the present embodiment, the path blocking member 40 rotates to switch between the blocking state and the open state. The switching unit 43 includes the torsion spring 47 as the pressing member that biases the path blocking member 40 toward the open state. The rack member 44 is displaced between the first position (see FIG. 2) where the path blocking member 40 is maintained in the blocking state against a pressing force from the torsion spring 47 and the second position (see FIG. 3) where the path blocking member 40 is allowed to assume the open state. Alternatively, the rack member 44 and the path blocking member 40 may be coupled to each other by a link rod, without using the torsion spring 47, so that the path blocking member 40 rotates as the rack member 44 is displaced.

Further, in the present embodiment, the paper sheet feeder 3 further includes: the reverse path R1 that reverses the paper sheet fed out from the paper sheet tray 10, the reverse path R1 being provided above the paper sheet tray 10 in the apparatus height direction as shown in FIGS. 2 and 3; and the path forming member 30 that forms at least part of the reverse path R1, wherein the rack member 44 is displaced along an underside of the path forming member 30 in the Y axis direction. Accordingly, a space under the path forming member 30 can be effectively used to prevent an increase in size of the apparatus.

Further, in the present embodiment, the paper sheet feeder 3 further includes the roller driving shaft 23 that transmits a rotation torque to the feeding roller 11, the roller driving shaft 23 being provided under the path forming member 30 in the apparatus height direction, wherein at least part of the pinion gear 45 and at least part of the roller driving shaft 23 overlap each other in the apparatus height direction. In FIG. 10, a range H1 indicates a range in which at least part of the pinion gear 45 and at least part of the roller driving shaft 23 overlap each other in the apparatus height direction. With this configuration, an increase in the apparatus height direction can be prevented. In the present embodiment, as seen from FIG. 10, the pinion gear 45 is included within the range of the roller driving shaft 23 in the apparatus height direction. Further, as seen from FIG. 10, at least part of the rotation shaft 26 and at least part of the roller driving shaft 23 overlap each other in the apparatus height direction. In particular, in the present embodiment, the rotation shaft 26 is included within the range of the roller driving shaft 23 in the apparatus height direction. Further, at least part of the rotation shaft 26 and at least part of the pinion gear 45 overlap each other in the apparatus height direction. In particular, in the present embodiment, the rotation shaft 26 is included within the range of the pinion gear 45 in the apparatus height direction.

Further, in the present embodiment, the feeding roller 11 and the rack member 44 are driven by a power supplied from the common motor 65. Accordingly, the cost for the apparatus can be reduced.

Further, in the present embodiment, the clutch mechanism 72 is disposed in a driving force transmission path from the motor 65 to the rack member 44, and the clutch mechanism 72 permits rotation of the motor 65 after the rack member 44 reaches a movement limit position. Accordingly, the rack member 44 does not interfere with rotation of the feeding roller 11.

Further, in the present embodiment, a reduction ratio in power transmission by the gear train shown in FIG. 7 is set such that, when the path blocking member 40 rotates from the blocking state to the open state, it moves along the paper sheet feed path T1 at a speed higher than a feeding speed of a paper sheet being fed along the paper sheet feed path T1 by a feeding force supplied from the feeding roller 11. Accordingly, it is possible to prevent the leading edge of the paper sheet fed out by the feeding roller 11 from being collapsed when it abuts the path blocking member 40. In other words, the path blocking member 40 does not interfere with transport of the paper sheet fed out by the feeding roller 11. The speed of the path blocking member 40 moving along the paper sheet feed path T1 can be defined as a speed of a position Ck, which is a position at which the abutment member 40*b* of the path blocking member 40 engages the guide member 12 as shown in FIG. 10, moving along the guide member 12 as the path blocking member 40 rotates.

Further, in the present embodiment, the paper sheet feeder 3 further includes: the delay unit 75 that delays a rotation start timing of the feeding roller 11 from that of the path blocking member 40 when the motor 65 in a stationary state is rotated to switch the path blocking member 40 from the blocking state to the open state. Accordingly, it is possible to prevent the leading edge of the paper sheet fed out by the feeding roller 11 from being collapsed when it abuts the path blocking member 40. The present embodiment has been described the delay unit 75 as having a configuration described in connection with FIG. 12. However, for example, when the rack member 44 and the feeding roller 11 are driven by separate motors, operation start timings of these two motors can be adjusted to delay the rotation start timing of the feeding roller 11 from the rotation start timing of the path blocking member 40. Further, even when the rotation start timings of the feeding roller 11 and the path blocking member 40 are the same, the delay unit can be omitted if there is a low possibility that the leading edge of the paper sheet is collapsed when it abuts the path blocking member 40.

Further, as shown in FIG. 10, the output tray 19 that receives a paper sheet outputted after recording is performed is disposed above the paper sheet tray 10 in the apparatus height direction. Further, in the present embodiment, at least part of the gear 59 constituting the switching unit 43 overlaps the output tray 19 in the apparatus height direction. In FIG. 10, a range H2 indicates a range in which the gear 59 and the output tray 19 overlap each other in the apparatus height direction. With this configuration, an increase in dimension in the vertical direction, that is, in the apparatus height direction can be prevented.

Figure 13:
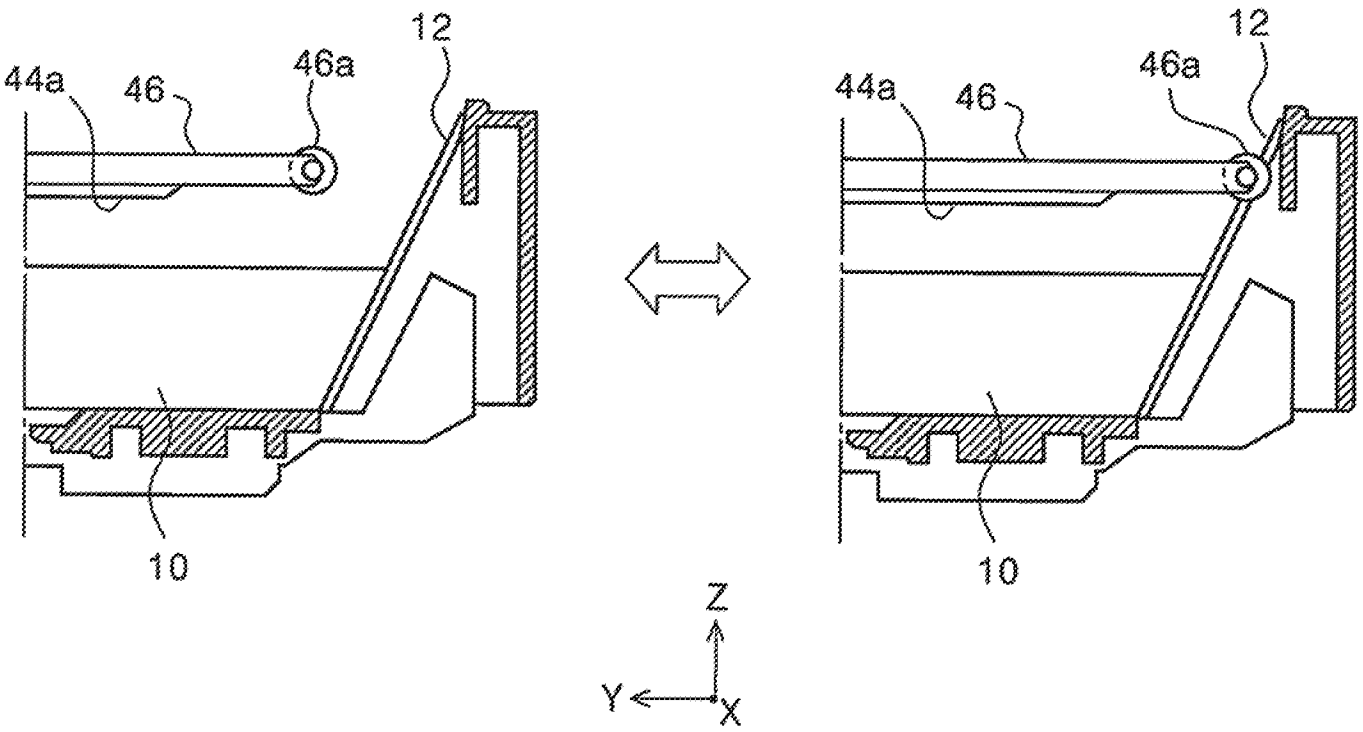
FIG. 13 is a view illustrating another embodiment of a path blocking member.

The present disclosure is not limited to the aforementioned embodiment. Various modifications can be made within the scope of the disclosure defined by the appended claims, and such modifications should be included in the scope of the disclosure. For example, as shown in FIG. 13, the paper sheet feed path may also be directly blocked by the rack member. In FIG. 13, reference numeral 46 is a modified example of the above rack member 44, and has a freely rotatable roller 46*a* on the −Y direction end facing the guide member 12. The rack member 46 is displaced in the Y axis direction to switch between a blocking state that blocks the paper sheet feed path T1 as shown in the right view in FIG. 13 and an open state that opens the paper sheet feed path T1 as shown in the left view in FIG. 13. That is, in the present embodiment, the rack member and the path blocking member are formed of the same member. Further, the roller 46*a* provided on the rack member 46 can reduce a friction resistance by the paper sheet when it comes into contact with the rack member 46 in the open state.

What is claimed is:

1. A medium feeder comprising:

a tray configured to contain a medium stacked in an apparatus height direction;

a feeding roller that feeds out the medium from the tray in a medium direction;

a guide member that faces a leading edge of the medium loaded in the tray and guides the leading edge of the medium fed out from the tray toward downstream in a feed direction;

a path blocking member configured to switch between a blocking state that blocks a feed path for a medium fed out from the tray at a position of the guide member, and an open state that opens the feed path; and a switching unit that performs switching of the path blocking member, wherein the switching unit includes a linear rack configured to be displaced in a rack feeding direction which is parallel to the medium feeding direction in which a medium is fed by the feeding roller from the tray toward the guide member, and a pinion gear that linearly drives the linear rack along the feeding direction, and the pinion gear contacts and engages the linear rack so that the linear rack directly contacts and performs switching of the path blocking member to the open state by being moved from a first position to a second position and the linear rack directly contacts and performs switching of the path blocking member to the blocking state by being linearly moved from the second position to the first position.

2. The medium feeder according to claim 1, wherein the path blocking member rotates to switch between the blocking state and the open state, the switching unit includes a pressing member that biases the path blocking member toward the open state, and the linear rack is displaced between the first position where the path blocking member is maintained in the blocking state against a pressing force from the pressing member and the second position where the path blocking member is allowed to assume the open state.

3. The medium feeder according to claim 2, further comprising:

a reverse path that reverses a medium fed out from the tray, the reverse path being provided above the tray in the apparatus height direction; and a path forming member that forms at least part of the reverse path, wherein the linear rack is displaced along an underside of the path forming member.

4. The medium feeder according to claim 3, further comprising:

a roller driving shaft that transmits a rotation torque to the feeding roller, the roller driving shaft being provided under the path forming member in the apparatus height direction, wherein at least part of the pinion gear and at least part of the roller driving shaft overlap each other in the apparatus height direction.

5. The medium feeder according to claim 2, wherein the feeding roller and the linear rack are driven by a power supplied from a common motor.

6. The medium feeder according to claim 5, wherein a clutch mechanism is provided in a driving force transmission path from the motor to the rack, the clutch mechanism being configured to permit rotation of the motor after the rack reaches a movement limit position.

7. The medium feeder according to claim 5, wherein the path blocking member moves along the feed path when it rotates from the blocking state to the open state at a speed higher than a feeding speed of a medium being fed along the feed path by a feeding force supplied from the feeding roller.

8. The medium feeder according to claim 5, further comprising a spring that mechanically generates a pressing force and delays a rotation start timing of the feeding roller from that of the path blocking member when the motor in a stationary state is rotated to switch the path blocking member from the blocking state to the open state.

9. A recording apparatus comprising:

a recording head that performs recording onto a medium; and the medium feeder according to claim 1.

10. The recording apparatus according to claim 9, further comprising:

a medium receiving unit that receives a medium outputted after recording is performed, the medium receiving unit being disposed above the tray in the apparatus height direction, wherein at least part of the switching unit overlaps the medium receiving unit in the apparatus height direction.

11. A medium feeder comprising:

a tray configured to contain a medium stacked in an apparatus height direction;

a feeding roller that feeds out the medium from the tray;

a guide member that faces a leading edge of the medium loaded in the tray and guides the leading edge of the medium fed out from the tray toward downstream in a feed direction;

a path blocking member configured to switch between a blocking state that blocks a feed path for a medium fed out from the tray at a position of the guide member, and an open state that opens the feed path;

a switching unit that performs switching of the path blocking member;

a reverse path that reverses a medium fed out from the tray, the reverse path being provided above the tray in the apparatus height direction;

a path forming member that forms at least part of the reverse path;

a reverse path that reverses a medium fed out from the tray, the reverse path being provided above the tray in the apparatus height direction;

a path forming member that forms at least part of the reverse path; and a roller driving shaft that transmits a rotation torque to the feeding roller, the roller driving shaft being provided under the path forming member in the apparatus height direction, wherein the switching unit includes a rack configured to be displaced in a feeding direction in which a medium is fed from the tray, and a pinion gear that drives the rack along the feeding direction, and the pinion gear contacts and engages the rack during causing the rack to move from a first position to a second position to perform switching of the path blocking member to the open state and causing the rack to move from the second position to the first position to perform switching of the path blocking member to the blocking state, the path blocking member rotates to switch between the blocking state and the open state, the switching unit includes a pressing member that biases the path blocking member toward the open state, the rack is displaced between the first position where the path blocking member is maintained in the blocking state against a pressing force from the pressing member and the second position where the path blocking member is allowed to assume the open state, the rack is displaced along an underside of the path forming member, and at least part of the pinion gear and at least part of the roller driving shaft overlap each other in the apparatus height direction.

* * * * *